United States Patent [19]

Kahn

[11] 3,944,749

[45] Mar. 16, 1976

[54] COMPATIBLE AM STEREOPHONIC RECEIVERS INVOLVING SIDEBAND SEPARATION AT IF FREQUENCY

[76] Inventor: Leonard R. Kahn, 70 N. Grove, Freeport L.I., N.Y. 11520

[22] Filed: July 10, 1974

[21] Appl. No.: 487,154

Related U.S. Application Data

[63] Continuation-in-part of Ser. No. 251,947, May 10, 1972, abandoned.

[52] U.S. Cl. ..... 179/15 BT; 325/36

[51] Int. Cl.[2] ..... H04H 5/00

[58] Field of Search ..... 179/15 BT, 15 BM; 325/36, 325/60; 343/200

[56] References Cited

UNITED STATES PATENTS

| | | | |
|---|---|---|---|
| 3,167,614 | 1/1965 | Holt et al. | 179/15 BT |
| 3,206,550 | 9/1965 | Fink | 179/15 BT |
| 3,218,393 | 11/1965 | Kahn | 179/15 BT |
| 3,350,645 | 10/1967 | Kahn | 325/137 |

*Primary Examiner*—Douglas W. Olms

*Attorney, Agent, or Firm*—Graybeal, Barnard, Uhlir & Hughes

[57] ABSTRACT

Amplitude modulation (AM) stereophonic transmission receivers for reception of a radiant energy carrier wave with two stereo related signals, each appearing as a first order single-sideband, the carrier wave preferably being also modulated with an infrasonic frequency (e.g. 15 Hz) signal indicating stereo signal presence (with such infrasonic frequency modulation being either amplitude modulated or phase modulated). The upper sideband and the lower sideband portions of the received signal are separately detected and through voltage comparison means are applied to the development of automatic switching control of the detector outputs to deliver as receiver outputs either stereophonically related audio signals in the presence of different upper and lower sideband detector outputs or to deliver monophonically related (i.e. combined) detector outputs in the instance of reception of a monophonically modulated carrier wave. Such voltage comparison means, operating on the respective upper and lower sideband detector outputs, is advantageously activated (i.e. gated) by the presence in at least one detector output of the infrasonic modulation signifying the presence of stereo related modulation of the carrier wave, the output from such voltage comparison means also providing, in addition to the automatic switching of the detector outputs to stereophonically related audio receiver output mode as above indicated, a visual output (suitably in the form of a stereo presence/tuning light) directly and visually indicating to the receiver operator the presence of a stereo signal, and also providing the operator with a means to tune the RF portion of the receiver accurately to the carrier frequency, the proper RF tuning being indicated by maximal intensity of the visual output. Modified forms of receiver circuitry are presented wherein, in a first instance, the IF passband is defined by a double sideband filter and the intelligence is separated into upper sideband and lower sideband portions by separate upper sideband and lower sideband filters, and, in the second instance, the IF passband is defined simply by upper sideband and lower sideband filters with a portion of the filter outputs summated and the envelope thereof separately detected to provide a monophonic audio output and an AGC signal.

10 Claims, 2 Drawing Figures

Fig. 1.
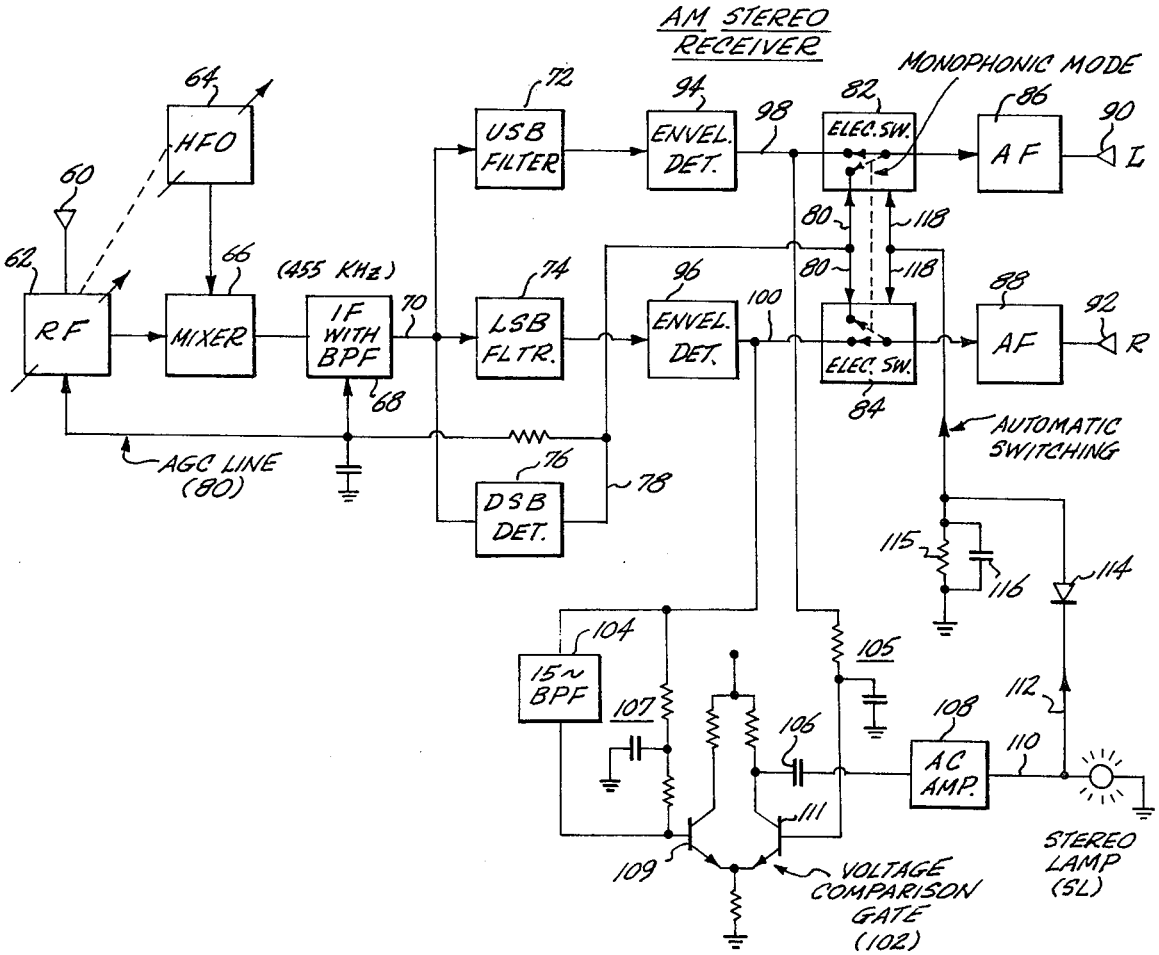
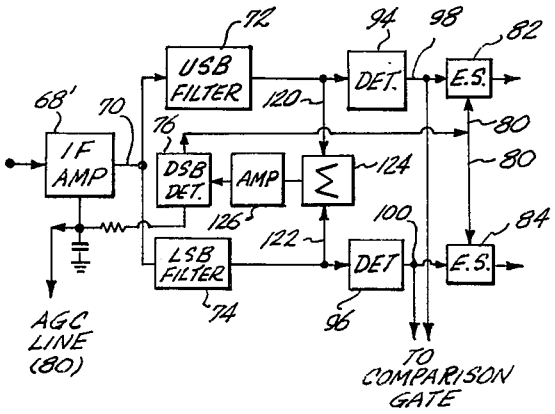
Fig. 2

COMPATIBLE AM STEREOPHONIC RECEIVERS INVOLVING SIDEBAND SEPARATION AT IF FREQUENCY

CROSS-REFERENCE TO RELATED APPLICATIONS

This application is a continuation-in-part of my U.S. application Ser. No. 251,947 entitled *AM Stereophonic Transmission and Reception System, and Methods and Components Utilized Therein*, filed May 10, 1972, and now abandoned. My related application entitled *Compatible AM Stereophonic Transmission System* Ser. No. 487,155, was filed July 10, 1974, also as a continuation-in-part of said application 251,947, and in general relates to an improved AM stereo transmission system.

BACKGROUND OF THE INVENTION

1. Field of the Invention

This invention relates to AM stereo receivers designed for reception of a carrier wave having stereo related intelligence appearing in the respective upper sideband and lower sideband of the transmitted signal such as disclosed in my prior U.S. Pat. No. 3,218,393, and in my aforesaid copending application Ser. No. 487,155 entitled *Compatible AM Stereophonic Transmission System*. An infrasonic frequency (e.g. 15 Hz) modulation of the carrier wave is preferably incorporated in the transmitted signal for indication in the receiver of the presence of a stereo modulated signal. Aspects of the invention also relate to specialized receiver circuitry with both stereophonic mode and monophonic mode capabilities and automatic switching therebetween.

2. Description of the Prior Art

Compatible stereophonic AM transmission and reception, involving stereo related upper and lower sidebands, with the difference stereo signal (channel A minus channel B) phase modulating the carrier wave and with the summation stereo signal (channel A plus channel B) envelope modulating the carrier wave, are disclosed in my U.S. Pat. No. 3,218,393, together with certain forms of receivers for stereophonic reception of a carrier wave so modulated. A further discussion of this compatible AM stereophonic modulation technique appears in my paper entitled "A Stereophonic System For Amplitude Modulated Broadcast Stations", which appears in IEEE Transactions on Broadcasting, Vol. BC-17, No. 2, June 1971, at pages 50–55. To the extent here relevant, the disclosures of this prior patent and this paper are incorporated herein by reference.

Also known are stereophonic transmission and reception systems as disclosed in Shoaf U.S. Pat. No. 3,009,151, involving a two-channel FM - AM stereo system wherein stereo related signals are respectively frequency modulated and amplitude modulated on FM band and AM band carrier waves; Colodny U.S. Pat. No. 3,031,529, disclosing a single channel AM stereo system employing synchronous detectors in the receiver portion of the system; Avins U.S. Pat. No. 3,068,475, disclosing a stereo transmission and reception system wherein one stereo related signal is amplitude modulated on a carrier wave and the other stereo related signal is frequency modulated on the same carrier wave; Barton U.S. Pat. No. 3,102,167, disclosing a two-channel, phaseshifted, double sideband stereo transmission; Fink U.S. Pat. No. 3,206,550, disclosing visual display of a stereo presence signal; Holt et al. U.S. Pat. No. 3,167,614, disclosing use of an infrasonic tone to indicate stereo signal presence in an AM/PM type transmission system; and Collins U.S. Pat. No. 3,231,672, disclosing an AM stereo system involving linearly added carrier waves at the same frequency but in different phase, with each of the carrier waves amplitude modulated with stereo related signals.

Also known is a system for transmission of stereophonic signals over telephone lines, as in Almering et al U.S. Pat. No. 3,803,490, granted June 3, 1974, wherein two different carrier frequencies are employed with a relatively wide bandwidth requirement (e.g. 65 kHz to 103 kHz with 8.06 kHz break), and with no attempt to make the system compatible from the point of view of detection of signals by envelope detection means.

Also notable as being of general interest, in the field of CSSB and stereophonic signal transmission are the following:

E.S. Purington, U.S. Pat. No. 2,020,327 Nov. 12, 1935.

O. G. Villard, Jr., "Composite amplitude and phase Modulation", Electronics, Vol. 21, November 1948, pp. 86–89.

L. R. Kahn, "Comparison of Linear Single-Sideband Transmitters With Envelope Elimination and Restoration Single-Sideband Transmitters", Proc. IRE, Vol. 44, December 1956, pp. 1706–1712.

J. Avins, et al., "Compatible Stereophonic System for the A.M. Broadcast Band", RCA Review, September 1960, pp. 299–359.

H. E. Sweeney and C. W. Baugh, Jr., U.S. Pat. No. 3,069,679, Dec. 18, 1962.

Philco Corporation, "Petition to the FCC For The Institution of Rule Making Proceedings Looking Toward the Adoption of Compatible AM Stereo Transmission Standards", filed Dec. 4, 1958.

J. M. Hollywood and M. Kronenberg, "A Stereophonic Transmission System for AM Broadcasting", *Journal of the Audio Engineering Society*, Vol. 9, No. 2, April 1961.

D. Gabor, "Theory of Communication", Proc. Inst. Elec. Eng., Vol. 93, 1946, pp. 429–457.

E. Bedrosian, "The Analytic Signal Representation of Modulated Waveforms", Proc. IRE, Vol. 50, October 1962, pp. 2071–2076.

W. L. Rubin and J. V. Difranco, "Analytic Representations of Wide-band Ratio Frequency Signals", J. Franklin Inst., Vol. 275, March 1963, pp. 197–204.

H. B. Voelcker, "Toward a Unified Theory of Modulation—Part I: Phase-envelope Relationships", Proc. IEEE, Vol. 54, March 1966, pp. 340–353.

R. E. Bogner, "Frequency Sampling Filters — Hilbert Transformers and Resonators", Bell Syst. Tech. J., Vol. 48, March 1969, pp. 501–510.

E. C. Titchmarsh, *Introduction to the Theory of Fourier Integrals*. New York: Oxford, 1937.

M. Schwartz, W. R. Bennett, and S. Stein, *Communication Systems and Techniques*. New York: McGraw-Hill, 1966.

A. Papoulis, *The Fourier Integral and Its Applications*. New York, McGraw-Hill, 1962.

H. E. Rowe, Signals and Noise in Communication Systems. Princeton, New Jersey: Van Nostrand, 1965.

L. R. Kahn, "Compatible Single-Sideband", Proc. IRE Vol. 49, October 1961, pp. 1503–1527.

SUMMARY OF THE INVENTION

One advantage and feature of the AM stereophonic transmission and reception system and method of the present invention is the use of an infrasonic frequency modulation to indicate in the receiver stereo signal presence, which signal and indication are utilizable to provide automatic shifting of the reception mode to and from stereophonic and monophonic and/or to provide a carrier tuning indicator. An additional feature of the present invention is the use in an AM stereo receiver of a single, fixed tuned intermediate frequency (IF) channel, with attendant efficiency and accuracy.

Other features and advantages of the invention will be apparent from the following description and discussion of certain typical embodiments of the invention.

BRIEF DESCRIPTION OF THE DRAWINGS

FIG. 1 is a diagrammatic showing, partly in block form and partly in schematic form, of a receiver designed to receive an AM stereo signal such as developed in the transmitter exciter shown in my copending application Ser. No. 487,155, for example, wherein the receiver incorporates means for separately developing the upper and lower sidebands of the received signal at IF frequency and for detection of an infrasonic frequency stereo presence signal and develops a visual indication of stereo signal presence and also develops an automatic switching control signal to automatically provide stereophonic or monophonic audio output depending upon the nature of the received signal; and FIG. 2 illustrates in block diagram form a portion of a modified form of receiver wherein the passband of the IF portion of the receiver is defined by an upper sideband filter and a lower sideband filter with a double sideband detector being fed from a summation of the signal outputs from such filters rather than the IF passband being defined by a single bandpass filter in the IF signal channel itself.

DESCRIPTION OF THE PREFERRED EMBODIMENTS

FIG. 1 illustrates a typical AM stereo receiver according to the present invention. The front end portion of the receiver, in a manner conventional per se, comprises a superheterodyne system in its RF and IF stages, i.e. antenna 60, variable RF amplifier 62, variable high frequency oscillator 64, mixer 66, and combined fixed frequency (e.g. 455 KHz) IF amplifier stages and IF bandpass filter, as collectively designated at 68.

According to the present invention the output 70 from the IF amplifier/filter 68 is applied to fixed frequency upper sideband and lower sideband filters 72, 74 and also to a conventional double-sideband detector 76, which typically is in the form of a diode detector. The output 78 from the double sideband detector stage 76 is utilized for AGC purposes in the conventional AGC line generally designated at 80, and also is applied as the monophonic signal inputs 80 to electronic switches 82, 84. In the case of monophonic signal reception, as discussed more fully hereinafter, the electronic switches 82, 84 apply the monophonic signal inputs 80 to the audio amplifiers 86, 88 and to respective speakers 90, 92 to provide normal monophonic reception.

In the case of reception of a stereo signal by the receiver, the respective upper and lower sideband filters 72, 74 which can take the form of ceramic filters, crystal filters, or conventional LC or transformer coupled circuits, function to separate the upper sideband portion and the lower sideband portion of the signal appearing in the IF passband. Filters 72, 74 characteristically have a fairly sharp curve for the lower edge of the upper sideband filter 72 and the upper edge of the lower sideband filter 74. These relatively sharp cutoff characteristics, besides providing good stereo suppression, can be utilized to slope detect the infrasonic frequency modulation component produced at the transmitter when a stereo signal is being transmitted. In FIG. 1 the lower sideband filter is used to slope detect the infrasonic angular modulation component. The resulting infrasonic wave is fed to the 15 Hertz bandpass filter 104 which in turn feeds an NPN type voltage comparison gate circuit, generally indicated at 102. The voltage comparison gate circuit 109 also is fed dc voltages produced (by the carrier) in the envelope detectors 94, 96. As will be apparent, the 15 Hz bandpass filter 104 could receive its input from either one of the sideband detectors 94, 96, or from the double sideband detector 76, the function of the filter 104 being to isolate and pass the 15 Hz stereo presence tone.

When the receiver is properly tuned and a stereo presence tone is present, the DC voltages from the two detectors 94, 96 are approximately equal and the comparison gate is properly biased to pass the tone through coupling condenser 106 and AC amplifier 108 to the stereo presence indicating lamp SL, energizing the lamp. When the receiver is not properly tuned, one of the detectors 94, 96 produces more DC voltage than the other with the result that the sections of the comparison gate 102 are unequally biased and the infrasonic frequency tone is blocked or partially so. In view of the direct relationship between the voltage of the output 110 and the tuning of the receiver (manifested by the relative strengths of signals in the upper sideband and lower sideband as they appear at detector outputs 98, 100) the stereo presence lamp SL can be utilized as a tuning sensor or indicator as well as to indicate stereo presence.

In addition to the comparison gate 102 output being applied through AC amplifier 108 to the stereo lamp SL, a further output thereof as indicated at 112 is applied to rectifier diode 114 and to a low pass filter circuit comprising diode load resistor 115 and filter capacitor 116 to provide the DC control signal inputs 118 to the electronic switches 82, 84. As will be readily understood, the presence of a DC control signal at inputs 118 changes the control condition of the electronic switches 82, 84 to break contact of the switch outputs to amplifiers 86, 88 with the monophonic inputs 80 and establish contact of the switch outputs with the stereo inputs 98, 100 in a manner known per se so that when the control signal inputs 118 are present the respective amplifiers 86, 88 receive inputs from the upper sideband and lower sideband detectors 94, 96.

RC filter circuits 105 and 107 in the voltage comparison gate 102 are provided with large enough time constants to effectively attenuate the infrasonic frequency stereo presence tone and any other low frequency audio components present, in a manner known per se. The filter circuits 105, 107 thus limit the path of the 15 Hz stereo presence tone to only filter 104 and the opposed transistors 109, 111 of gate 102. If either of transistors 109, 111 is biased off the infrasonic tone is blocked and does not reach amplifier 108. As will be readily understood, the amplitude of the gate 102 output to amplifier 108 is determined by the DC components of the applied voltages (detector outputs 98, 100), with maximum output occurring when such DC components are equal, and with there being no output if the receiver is not properly tuned and one or both of the sections of the gate 102 is consequently non-conductive.

FIG. 2 illustrates in partial block form a modified form of receiver according to the present invention. In this instance, and utilizing like numerals to designate like circuit components, the If amplifier 68', which in this modification need not have or include a bandpass filter stage, applies its output 70 to upper and lower sideband filters 72, 74, which in turn feed respective detectors 94, 96 and also provide inputs 120, 122 to a summation circuit 124, the output from which passes through an IF amplifier 126 to double sideband detector 76 which, in like manner as shown in FIG. 1, provides an output to the AGC line 80 and a further output 78 to the monophonic inputs 80 of the electronic switches 82, 84. The significant difference in this modified form of receiver circuitry, as compared with the form in FIG. 1 (and with respect to which is otherwise the same), is that the AM selectivity is derived solely from the upper and lower sideband filters 72, 74, without separate selectivity being provided in the IF channel or otherwise for the double sideband portion of the system. Elimination of one filter from the circuit can be advantageous in adaptation of the receiver circuitry to integrated circuits. In employment of this modified form of selectivity, the upper and lower sideband filters 72, 74 are preferably constructed to provide phase and amplitude relationships at carrier frequency so that the carrier level is not attenuated relative to levels of the sidebands. For flat response the carrier crossover point should be about 6 db down and the two filters should be in phase at the crossover point. In some instances it is desirable to provide some carrier boost, i.e. design the filters to be 3 db down at the crossover point for example, which renders the receiver performance slightly better from the point of view of minimizing the effect of selective carrier fading. In such case monophonic listeners could enjoy a slightly improved fading characteristic and possibly slight bass boost. The bass boost, if considered undesirable, can be removed in the receiver, as by suitable audio coupling circuits between the double-sideband detector and the electronic switching circuits.

As will be understood by those skilled in the art, the voltage difference between the DC components of the detectors 94, 96 can also be utilized for automatic frequency control (AFC) purposes, if desired, in a manner known per se.

What is claimed is:

1. The method of indicating stereo signal presence in a stereo receiver and utilizing such stereo signal indication to control receiver audio output mode, comprising:

a. modulating an infrasonic frequency tone on a carrier wave modulated by stereo related audio signals, b. transmitting the carrier wave thus modulated, c. separately detecting the stereo related audio signals in the receiver, d. comparing the DC components of the detected stereo signals, e. demodulating out such infrasonic frequency tone in the stereo receiver, f. controlling the audio output channels of the stereo receiver responsive to the presence of such tone to apply stereo related audio signal inputs thereto when the tone is present, and g. passing the isolated infrasonic frequency tone to visual indicator means when the DC components of the compared stereo signals are substantially equal, such visual indicator means thereby providing an indication of stereo presence.

2. The method of claim 1, wherein said infrasonic frequency tone is at a frequency of about 15 Hz.

3. The method of claim 1, wherein the carrier wave is phase or frequency modulated with the infrasonic frequency tone at a modulation level corresponding to a modulation index of less than about one.

4. The method of claim 1, wherein the carrier wave is amplitude modulated with the infrasonic frequency tone at a modulation level of less than about 10 percent.

5. A system for receiving a compatible single sideband radio frequency carrier wave with stereo related intelligence appearing as upper and lower sidebands of the carrier wave and with an infrasonic tone also modulated on the carrier wave to indicate stereo presence and to control receiver audio output mode, comprising:

a. means separately detecting the stereo related audio signals, b. means comprising the DC components of the detected stereo signals, c. means for demodulating out the infrasonic frequency tone, d. means controlling the audio output channels of the stereo receiver responsive to the presence of such tone to apply stereo related audio signal inputs thereto when the tone is present, and e. means passing the isolated infrasonic frequency tone to visual indicator means when the DC components of the compared stereo signals are substantially equal, such visual indicator means thereby providing an indication of stereo presence.

6. The system of claim 5, wherein said infrasonic frequency tone is at a frequency of about 15 Hz.

7. The system of claim 5, wherein the carrier wave is phase or frequency modulated with the infrasonic frequency tone at a modulation level corresponding to a modulation index of less than about one.

8. The system of claim 5, wherein the carrier wave is modulated with the infrasonic frequency tone at a modulation level less than about 10 percent.

9. A stereophonic radio receiver for receiving a carrier wave modulated by two stereo related audio signals with at least most of the stereophonically distinguishable components of one stereophonic signal appearing as one first order single sideband of the carrier wave and at least most of the stereophonically distinguishable components of the other stereophonic signal appearing as the other first order single sideband of the carrier wave, and with said carrier wave further modulated at low level with an infrasonic frequency tone utilizable in the receiver to indicate the presence of stereo related signals, said receiver comprising:

a. superheterodyne means developing an IF signal and including IF bandpass means passing both the USB and LSB of the received signal, b. means developing from the output of said IF bandpass means separate USB, LSB and DSB outputs at IF frequency, c. separate amplitude modulation detector means separately responsive to each of the USB, LSB and DSB outputs, d. means receiving an input from one of the detector outputs and isolating therefrom the said infrasonic frequency tone, e. gate means receiving as control inputs portions of the detected USB and LSB outputs including the DC components thereof, said gate means being operable to pass the controlled input thereto only when said DC components are approximately equal, f. means applying the isolated infrasonic frequency tone as the controlled input to said gate means, and g. means applying the output from said gate means to electronic switching means connected in one position to apply the respective USB and LSB detector outputs to respective stereo audio output channels and in the other position to apply the DSB detector output to both said audio output channels.

10. A stereophonic radio receiver for receiving a carrier wave modulated by two stereo related audio signals with at least most of the stereophonically distinguishable components of one stereophonic signal appearing as one first order single sideband of the carrier wave and at least most of the stereophonically distinguishable components of the other stereophonic signal appearing as the other first order single sideband of the carrier wave, and with said carrier wave further modulated at low level with an infrasonic frequency tone utilizable in the receiver to indicate the presence of stereo related signals, said receiver comprising:

a. superheterodyne means developing an IF signal and including IF bandpass means passing both the USB and LSB of the received signal, b. bandpass filter means developing from the output of said IF bandpass means separate USB, LSB and DSB output at IF frequency, c. separate amplitude modulation detector means separately responsive to each of the USB, LSB and DSB outputs, d. gate means receiving as control inputs the DC components of the detected USB and LSB outputs and controlled thereby to pass the controlled input thereto only when said DC components are approximately equal, e. low pass filter means receiving an input from one of the detector outputs and isolating therefrom the said infrasonic frequency tone, f. means applying the isolated infrasonic frequency tone as the controlled input to said gate means, g. means applying the output from said gate means to stereo presence visual indicator means, and h. means applying the output from said gate means to electronic switching means connected in one position to apply the respective USB and LSB detector outputs to respective stereo audio output channels and in the other position to apply the DSB detector output to both said audio output channels.

* * * * *